US005236138A

United States Patent [19]

Stangenberg et al.

[11] Patent Number: 5,236,138

[45] Date of Patent: Aug. 17, 1993

[54] DOCUMENT SHREDDER

[75] Inventors: Hartmut Stangenberg, Owingen; Rolf Gasteier, Bermatingen, both of Fed. Rep. of Germany

[73] Assignee: Schleicher & Co. International Aktiengesellschaft, Fed. Rep. of Germany

[21] Appl. No.: 850,121

[22] Filed: Mar. 12, 1992

[30] Foreign Application Priority Data

Mar. 12, 1991 [DE] Fed. Rep. of Germany ..... 4107837

[51] Int. Cl.[5] ..... B02C 7/16

[52] U.S. Cl. ..... 241/36; 241/236

[58] Field of Search ..... 241/36, 236, 35; 83/331

[56] References Cited

U.S. PATENT DOCUMENTS 3,602,784 8/1971 Euler ..... 318/290 X
4,496,105 6/1985 Fleming et al. ..... 241/35 X
4,545,537 10/1985 Kimura et al. ..... 241/36
4,609,155 9/1986 Garnier ..... 241/36 X
4,619,407 10/1986 Goldhammer ..... 241/36 X
4,709,197 11/1987 Goldhammer et al. ..... 241/36 X

FOREIGN PATENT DOCUMENTS 3112913 10/1982 Fed. Rep. of Germany .
3208676 10/1982 Fed. Rep. of Germany .
3612788 9/1986 Fed. Rep. of Germany .
2096919 10/1982 United Kingdom .

*Primary Examiner*—Frank T. Yost
*Assistant Examiner*—Kenneth E. Peterson
*Attorney, Agent, or Firm*—Quarles & Brady

[57] ABSTRACT

A document shredder (11) has a cutting mechanism (13), which is driven via a gear (25) by an electric motor (26). In the return movement a diode (30) is connected in, which reduces the voltage supplied to the motor and therefore its maximum torque.

This avoids material being jammed on the top of the cutting mechanism during the return movement in such a way that the cutting mechanism cannot be rotated again during the following forward movement.

8 Claims, 1 Drawing Sheet

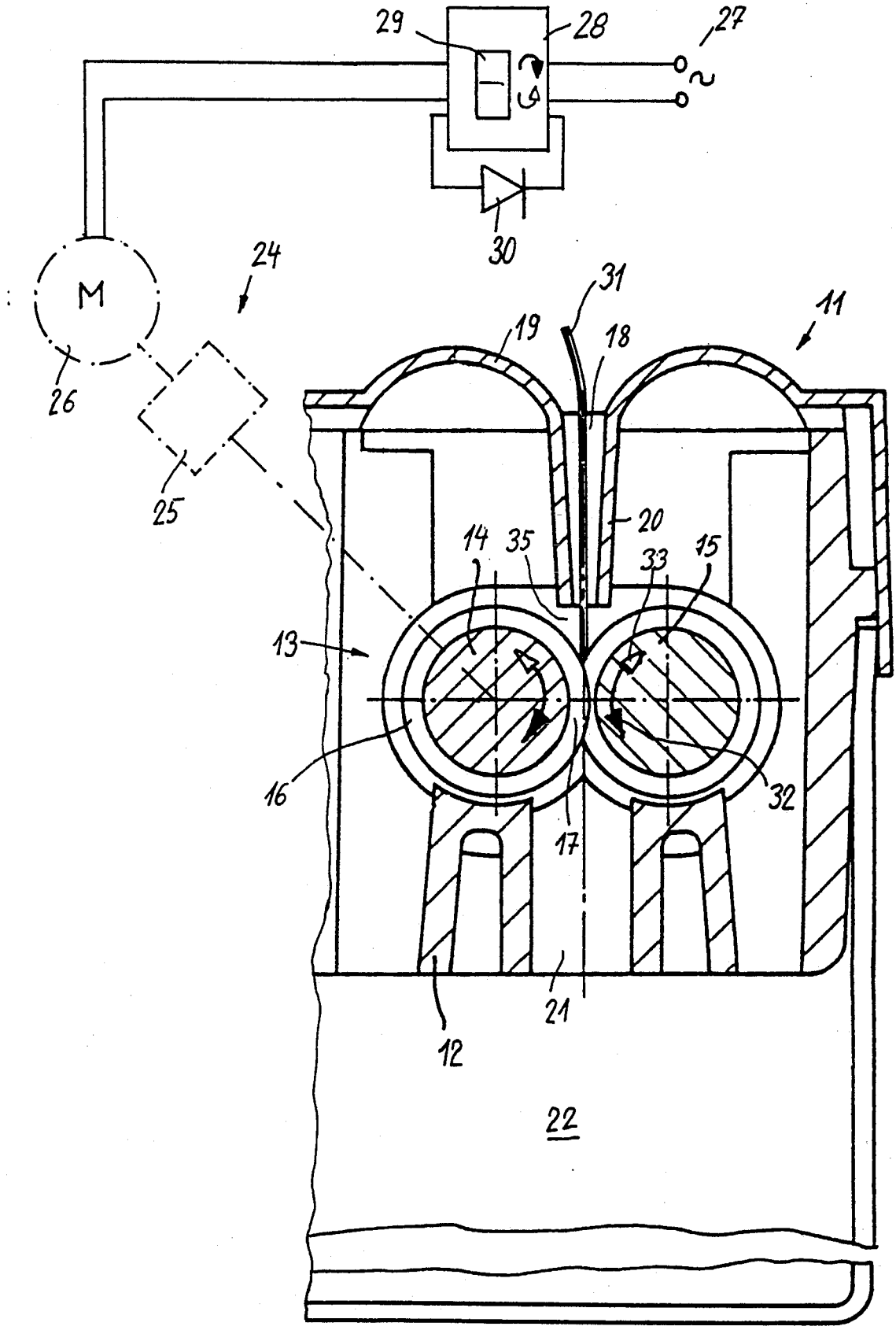
29
28
27
30
M
24
26
25
31
19
18
11
20
14
35
33
15
13
16
32
17
21
12
22

DOCUMENT SHREDDER

BACKGROUND OF THE INVENTION

In the case of document shredders with a motor driven cutting mechanism the drive can normally be reversed between forward and return movement, so that the cutting mechanism can be freed from a locking effect by the return movement and which has e.g. resulted from the feeding in of an excessively thick document, by articles which cannot be readily cut, etc. This normally takes place by reversing the electric motor.

OBJECT AND SUMMARY OF THE INVENTION

An object of the invention is to improve the freedom from faults of a document shredder.

As a result of torque reducing means the torque applied during the return movement of the cutting mechanism and in particular the braking moment, i.e. the torque which leads to the locking of the motor, is lower than the corresponding torque in the forward movement of the motor and in particular the maximum starting torque of the motor. Thus, during motor return movement the cutting mechanism is prevented from returning already cut material towards the feed shaft and is jammed at said shaft or at other casing points and consequently compacted to such an extent that the cutting mechanism is jammed in such a way that during the forward movement it cannot be started again by the drive. This measure is particularly important in the case of shredders, which operate with stripper-free cutting rollers, which cut the documents into individual strips and not into individual particles because, particularly from a relatively full waste container these strips could again draw the material upwards. Particularly if the feed channel is relatively narrow, because the shredder is only designed for a few sheets, the jamming risk is particularly high. The torque reducing means ensure that a jamming or wedging occurring during the return movement is not so strong that it cannot be removed again by the more powerful starting moment of the motor.

This preferably takes place by the electrical reduction of the return torque of the electric drive motor. However, it could also take place by corresponding gear measures, e.g. by a smaller gearing down in the return movement or a mechanical torque limitation in the return movement.

In a particularly simple and effective construction the alternating current electric motor is only supplied with parts of the full a.c. voltage power supply in the return movement, e.g. with the aid of an electronic or mechanical component. It is particularly favourable to only transmit one half-wave by switching in a diode.

With particular advantage the electric motor is a universal motor, which reacts to increasing power reduction with a considerable speed reduction. Whereas normally in the case of shredders use is made of motors with a pronounced tilting moment characteristic, i.e. motors which at a substantially unchanged speed can be loaded to a specific torque and then lock, by reducing the speed in reaction to the power decrease it is possible to work with smaller motor dimensions and the cutting configuration up to locking becomes more gentle. In addition, by the reaction of the cutting mechanism, the user is provided with a clear indication of a possible overloading and can react as a consequence thereof.

In special cases it is also possible and is proposed by the invention to make the arrangement such that the shredder operates with reduced power in the forward movement and with normal power in the return movement. This case can e.g. occur when the shredder is used in interlinked manner with other equipment.

These and further features can be gathered from the claims, description and drawings and the individual features, both singly and in the form of subcombinations, can be realized in an embodiment of the invention and in other fields and can represent advantageous, independently protectable constructions for which protection is hereby claimed.

BRIEF DESCRIPTION OF THE DRAWINGS

FIG. 1 shows a partial cross section through the document shredder of the present invention and a diagrammatic representation of the drive and its circuit diagram.

DESCRIPTION OF A PREFERRED EMBODIMENT

The document shredder 11 has a frame 12, in which is mounted a cutting mechanism 13. It comprises two horizontal, parallel cutting rollers 14,15 with cutting disk or wheels 16 arranged in axially spaced manner, which overlap one another and form a cutting gap 17 between them. Into the cutting gap passes a feed channel 18, which is constructed as a relatively narrow, conical and slot-like gap on a casing hood 19, which covers the top of the casing frame 12.

The boundary walls 20 of the feed channel 18 terminate just above the cutting gap 17. On the underside of the cutting gap is formed a discharge channel 21 through which the documents cut into strips by the cutting disks 16 drop into a container 22.

The cutting rollers 14,15 are so coupled together by not shown gear wheels arranged on their shafts, that they always contrarotate synchronously at the same speed. They are driven by a drive 24, which has a gear 25 and an electric motor 26. The gear is usually a multistage spur gearing, which is optionally supplemented by a belt transmission. The electric motor 26 is preferably a universal a.c. motor, whose torque characteristic is such that with increasing output torque the motor significantly reduces its speed and normally to a certain extent in a proportional manner. As a result for the same power input, by reducing the speed the motor can reach a higher final torque to locking and consequently both from the standpoint of its dimensions and in particular the maximum power consumption is more favourable than a motor with a pronounced tilting moment.

The motor is supplied by the two-phase a.c. power supply 27 via a switching device 28, which contains a forward/reverse switch 29. A diode 30 is provided, which is switched into the motor circuit if the switch is operated in the reverse direction.

The motor control can contain further safety and functional elements, e.g. a heat coil for the motor, a starter switch, which only puts the motor into operation when a document has been introduced, etc. It is also possible to provide an automatic reversing mechanism which, following the locking of the motor, automatically initiates the return movement.

The document shredder operates as follows. If the machine is supplied by the feed slot or channel 18 with a document 31, which also includes one or more sheets of paper or random other written matter or flat materials, and the machine is put into operation, e.g. by a mechanical or optical switch, by means of the gear 25 the motor 26 drives the cutting rollers in such a way that the document 31 is drawn into the cutting gap 17 and is cut into strips. The cutting rollers contrarotate in the sense of the black rotation direction arrows 32 (forward movement). The strips drop through the discharge gap into the container 22.

Particularly in the case of a machine where switching on takes place by a switch located in the feed channel 18, the upper edge of the document (as a function of the size of the cutting mechanism lag) frequently sticks in the cutting gap. This certainly always occurs if the document is so thick that it locks the cutting mechanism. In this case by means of the switch 29 or also automatically the motor 26 is reversed and the cutting rollers are driven counter to their cutting direction (white rotation direction arrows 33). Thus, to the extent that the document is still stuck in the feed channel 18, it is partly moved upwards and outwards through the same. Already cut material and particularly material adhering thereto from an e.g. very full container 22 can also be drawn upwards through the cutting gap 17 and can become wedged in the space 35 formed between the cutting gap and the feed channel boundaries 20, so that the cutting mechanism is finally also locked in the return direction.

However, by the switching in of the diode 30, the motor 26 would be supplied with a lower power (half the power supply). Therefore the braking moment in the return movement is much lower, although usually higher than half the corresponding moment in the forward rotation direction. If now switching once again takes place into the forward direction, this higher starting moment can easily release the locking which has occurred in the return direction and the jammed material can again be drawn through the cutting gap and drops in cut form into the container. The electric power reduction could also take place in some other way, e.g. by different phase angle control methods, by interposed resistors, the control of only part of the motor windings, etc.

We claim:

1. Document shredder comprising drive means including a motor;

a document feed channel through which documents can be supplied to the cutting mechanism and a cutting mechanism driven by said motor, said drive means being reversible between a forward movement, in which the cutting mechanism is driven in a direction to move documents from said feed channel through the cutting mechanism in order to cut the documents, and a return movement, in which the cutting mechanism is driven in a direction opposite to the forward movement direction;

said drive means maintaining at least a predetermined minimum amount of torque when acting in the forward movement, and said drive means having torque reducing means maintaining an amount of torque less than the predetermined minimum amount when acting in the return movement.

2. Document shredder according to claim 1, wherein the motor being an electric a.c. universal motor with a characteristic of speed decreasing significantly in response to increasing torque.

3. Document shredder according to claim 1, wherein the torque reducing means influence a braking moment of said drive.

4. Document shredder according to claim 1, wherein the torque reducing means reduces torque during said return movement of said motor, being an electric motor.

5. Document shredder according to claim 4, wherein the torque reducing means comprise electric means, which supply the electric motor, being an a.c. motor, in its return movement, only with part of an a.c. voltage cycle path of the voltage supplied to the shredder.

6. Document shredder according to claim 1, wherein the torque reducing means have an electronic component for reducing the torque.

7. Document shredder according to claim 6, wherein the torque reducing means contain a diode.

8. Document shredder according to claim 1, wherein the torque reducing means have a mechanical component for reducing the torque.

* * * * *